United States Patent [19]

Anzawa et al.

[11] Patent Number: 4,786,338

[45] Date of Patent: Nov. 22, 1988

[54] METHOD FOR COOLING ROLLED STEELS

[76] Inventors: Norio Anzawa; Takeshi Takahashi; Fumitaka Iori; Kouichi Hasegawa; Naoki Watanabe; Junji Nishino, all of c/o Nippon Steel Corporation, Muroran Works, No. 12, Nakamachi, Muroran City, Hokkaido, Japan

[21] Appl. No.: 924,816

[22] Filed: Oct. 30, 1986

[30] Foreign Application Priority Data

| | | | |
|---|---|---|---|
| Oct. 31, 1985 | [JP] | Japan | 60-242865 |
| Oct. 31, 1985 | [JP] | Japan | 60-242866 |
| Dec. 16, 1985 | [JP] | Japan | 60-281167 |
| Apr. 14, 1986 | [JP] | Japan | 61-84183 |
| Apr. 14, 1986 | [JP] | Japan | 61-84184 |
| Aug. 8, 1986 | [JP] | Japan | 61-185055 |

[51] Int. Cl.[4] ..... C21N 11/00

[52] U.S. Cl. ..... 148/12.4; 148/12 B; 148/128; 148/156

[58] Field of Search ..... 148/12 B, 156, 128, 148/143, 12.4

[56] References Cited

U.S. PATENT DOCUMENTS

| | | | |
|---|---|---|---|
| 2,756,169 | 7/1956 | Colson et al. | 148/156 |
| 2,994,328 | 8/1961 | Lewis | 266/113 |
| 4,046,599 | 9/1977 | Economopodos | 148/12 B |

FOREIGN PATENT DOCUMENTS

| | | | |
|---|---|---|---|
| 13230 | 7/1980 | European Pat. Off. | 266/111 |
| 49-134513 | 12/1974 | Japan . | |
| 51-20283 | 6/1976 | Japan . | |
| 51-99619 | 9/1976 | Japan . | |
| 52-35007 | 9/1977 | Japan . | |
| 55-41813 | 9/1980 | Japan . | |
| 56-44935 | 10/1981 | Japan . | |
| 56-48566 | 11/1981 | Japan . | |
| 57-114638 | 7/1982 | Japan . | |
| 61-12830 | 1/1986 | Japan . | |

*Primary Examiner*—Christopher W. Brody

*Attorney, Agent, or Firm*—Wenderoth, Lind and Ponack

[57] ABSTRACT

Steel hot-rolled to the desired diameter and allowed to travel forward is quenched with cooling water to a temperature below the bainite transformation temperature chosen from within the following range:

$$145 \cdot t/r^2 + 130 \leqq T \leqq 152 \cdot t/r^2 + 240$$

where

T = surface temperature of the rolled steel at a point 1 m to 2 m away form the point where quenching ends (°C.)

t = time required by the rolled steel for travelling from the quenching ending point to the temperature measuring point (hr)

r = radius of the rolled steel (m).

Then, the surface area of the rolled steel is subsequently automatically recovered by the heat of the core.

5 Claims, 4 Drawing Sheets

LEGEND

| CLASSIFICATION | SYMBOL | STEEL DIAMETER |
|---|---|---|
| THIS INVENTION | ○ | 7.4 Φmm |
| | ● | 12.0 Φmm |
| PRIOR ART | × | 9.2 Φmm |

METHOD FOR COOLING ROLLED STEELS

BACKGROUND OF THE INVENTION

Field of the Invention

This invention relates to a method and apparatus for cooling rolled steels, and more particularly to a method and apparatus for cooling rolled steels whereby excellent low-temperature toughness is obtained by rapidly cooling and hardening just-rolled high-temperature steels in cooling water and thus improving their surface grain structure.

Description of the Prior Art

A method disclosed in Japanese Provisional Patent Publication No. 114638 of 1982 is an example of several known methods of producing roller steels having excellent low-temperature toughness by directly improving their surface grain structure (through the application of surface hardening). According to this method, the surface area of steel product hot-rolled to a given diameter or cross-sectional size is successively cooled with water spray from above the $Ar_1$ transformation temperature to below the bainite transformation temperature, or preferably from above the $Ar_3$ transformation temperature. Namely, the cooling is effected so that the ratio of the heat-transfer rate $\alpha_s$ at the surface of the rolled steel to the heat-transfer rate $_i$ across the radius thereof is $\alpha_s > \alpha_i$. It is known that the surface portion of the rolled steel thus rapidly cooled and from which the water is then removed by means of high-pressure air blown thereagainst and which is thus further cooled becomes hot again the temperature becomes reelevated to a reelevated temperature, because of the heat transferred from the hotter core while being conveyed in the atmosphere from the water-cooling apparatus to cooling beds or a coiler (as disclosed in Japanese Provisional Patent Publications Nos. 134513 of 1974, 90912 of 1976 and 99619 of 1976).

As was proposed n Japanese Patent Publication No. 48566 of 1981, the water-cooling apparatus comprises a plurality of cooling units (cooling boxes) that are disposed in tandem. Each cooling box has annular forward- or backward spraying nozzles from which high-pressure cooling water is ejected against the rolled steel. The aforementioned water-removing apparatus is provided midway in the series of cooling boxes.

To produce products having the desired mechanical properties, the cooling rate and time must be controlled in accordance with the diameter or cross-sectional size of rolled steels. For this purpose, the surface temperature of the rolled steel has conventionally been determined at a point considerably far away from the exit end of the cooling apparatus so that the cooling rate could be controlled through the adjustment of the amount or pressure of the cooling water in accordance with the determined temperature.

In the conventional method just described, the recovered temperature measured at a point considerably far away from the exit end of the cooling apparatus has been used as the basis for controlling the amount or pressure of the cooling water. As such, when a problem arose, it has been difficult to quickly apply a corrective action to the following portion of the same piece or to the next piece. It takes approximately 10 to 60 seconds for the rapidly cooled piece to reach the reelevated temperature measuring point, so application of a corrective action within the same piece has been delayed by the same length of time. Also, a similar delay has occurred when the delivery interval between the defective piece and the next piece was shorter than the above time that is needed in reaching the reelevated temperature measuring point. Because of this shortcoming, the approximate length of the rapidly cooled section and the required amount of cooling water have had to be predetermined using a test material. Not only has such a testing procedure has been non-productive, but also the used test material has had to be discarded as scrap.

With the conventional method just described, the cooling rate and end-point temperature in quenching have had to be estimated by simulation or other similar technique on the basis of the reelevated surface temperature at a point considerably far away from the exit end of the cooling apparatus. Here, the end-point temperature of quenching means the surface temperature that is reached when the rolled piece has been cooled to a given temperature from the surface to a desired depth thereunder. Meanwhile, the cooling rate varies intricately with other operating conditions, so it is difficult to exactly tell whether quenching to the desired depth had been achieved only on the basis of the temperature measured on the exit side of the cooling apparatus. Accordingly, it has been difficult to perform uniform quenching at the desired cooling rate that is essential to steady production of steel products having the desired mechanical properties. Simulation has had to be done over again every time operating conditions changed, resulting in inefficient operation control.

In the rolling of bars and wire rods, various rolling conditions, such as their diameter, rolling speed or the length of time in which they pass through a cooling apparatus, are varied from time to time. For the production of satisfactory products, it is essential to provide an optimum cooling apparatus that functions appropriately with varying conditions. Particularly, the production of rolled steel for low-temperature services having excellent low-temperature toughness calls for extremely close control. Therefore, the temperature with which the piece leaves the finishing stand, the temperature at which quenching is finished and/or the reelevated temperature of the piece must be controlled at appropriate levels.

If the cooling area is longer than necessary, for instance, the cooling time becomes too long. Then, if the reelevated temperature is kept within the desired range, the quenching ending temperature becomes so high that the desired limit is exceeded. If, conversely, the quenching ending temperature is kept within the desired range, the reelevated temperature becomes too low. In all such cases, satisfactory products cannot be obtained. If the cooling area is too short, the results are reversed. Neither the quenching ending temperature nor the reelevated temperature can be brought in the desired range through the control of cooling water volume or pressure alone. Conceivably, adjustment of the rolling speed or cooling area length will offer a solution to this problem. But the rolling speed cannot be varied freely because of the limitation on mill load and other factors. In contrast, the cooling area length can be appropriately chosen with relative ease. Conventionally, the cooling area length has been empirically determined on the basis of the operational data of the past, for want of any other appropriate measures to cope with varying rolling conditions. When the rolling speed was varied because of the need to roll various sizes of products or of the limited rolling mill capacity, however, quick response has been difficult to achieve. Consequently, it has been difficult to steadily attain the desired properties.

SUMMARY OF THE INVENTION

This invention relates to a method and apparatus for cooling rolled steels that offers a solution to the problem just described.

A rolled-steel cooling method according to this invention controls the cooling conditions so that the surface temperature of the rolled piece comes within the prespecified range at a measuring point 1 to 2 m away from the exit end of a quenching line designed to the required length.

To be more specific, the rolled-steel cooling method of this invention comprises the steps of hot-rolling the steel piece to the desired diameter, quenching the piece with cooling water that is sprayed onto the travelling piece until the surface temperature comes within the following range that is not higher than the bainite transformation temperature $$145 \cdot t/r^2 + 130 \leqq T \leqq 152 \cdot t/r^2 + 240$$

where

T = surface temperature of the piece at a measuring point 1 to 2 m away from the point where quenching ends (°C.)

t = time for the piece to travel from the quenching ending point to the temperature measuring point (hr)

r = radius of the piece (m)

and allowing the temperature of the surface area of the piece to rise to the reelevated temperature by means of the heat retained in the core of the piece.

Control of the cooling water supply rate depends solely on the requirement that the surface temperature of the piece fresh from the quenching line be kept within the above-specified range. When any problem occurs during rolling, quick corrective action can be taken with the remaining portion of the same piece and the next piece. This permits steady production of rolled steels having excellent low-temperature toughness, along with the achievement of increased production and improved yield.

According to this method, the surface temperature of the rolled piece is measured immediately after the sprayed water has been wiped off and while the piece is travelling in the atmosphere. Based on the temperatures measured at the above two points, the process is controlled to ensure that the rolled piece is cooled at the desired cooling rate. This type of control permits stable production of rolled steels having the desired mechanical properties. The volume of cooling water can be readily controlled based on the measured temperatures, without requiring simulation that has conventionally been indispensable.

A cooling apparatus according to this invention is provided immediately after a rolling mill on which steel is hot-rolled to the desired diameter, comprising means to spray water onto the surface of the travelling piece. The length L (mm) of the cooling water spray zone that extends along the pass line of the piece is specified as follows:

$$L = 0.9 \cdot d^2 \cdot V(9.80 - 0.97 \cdot lnQ) + K$$

$$0.5 \geqq Q/\pi dL \cdot 10^3 \geqq 0.2$$

where d = diameter of the piece (mm)

V = rolling speed (m/sec)

Q = feed rate of cooling water ($m^3$/hr)

K = coefficient of correction selected within the range of −9000 mm to +3000 mm

The invention includes the process of allowing the temperature to rise to the reelevated temperature that is provided subsequent to the water-spray unit. The temperature is automatically increased to the reelevated temperature in the surface area of the piece that travels through the atmosphere by the heat of the core.

The cooling apparatus according to this invention can cope with frequent changes in the product size or rolling speed by appropriately adjusting the length L of the cooling water spray zone to the changed rolling speed or cooling water feed rate. Despite such changes in the rolling conditions, the temperature required for the attainment of excellent product quality is steadily secured. Elimination of empirical adjustment eradicates operational variations among different operators.

DESCRIPTION OF THE PREFERRED EMBODIMENTS

Figure 1:
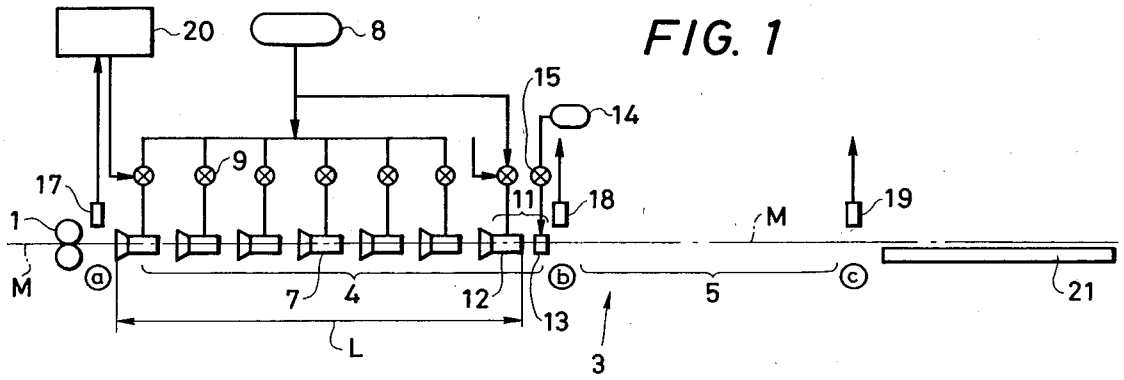
FIG. 1 is a schematic drawing of a cooling apparatus in which the cooling method of this invention is implemented.

FIG. 1 schematically shows a cooling apparatus with which the cooling method according to this invention is implemented. As is obvious, a finishing mill 1 is followed by a cooling line 3 and cooling beds 21. The cooling beds 21 may be replaced by a coiler. The diameter of rolled steel shapes treated in the cooling line 3 of this preferred embodiment ranges from 5.5 mm to 120 mm.

The cooling line 3 is made up of a quenching zone 4 and a temperature recovering zone 5. The quenching zone 4 comprises a series of cooling boxes 7 and a retro-blowing water remover 12. Each cooling box 7 contains an annular forward- or backward-spray nozzle arrangement, to which cooling water is supplied from a header 8 through a control valve 9. Rolled steel M travelling through cooling boxes 7 is cooled with water sprayed from the nozzles disposed therearound. A water removing device 11 is provided between the quenching zone 4 and the temperature recovering zone 5. The water removing device 11 comprises the retro-blowing water remover 12 and an air blower 13 which leads to a compressed-air reservoir 14 through a stop valve 15. When the rolled steel M enters the water removing device 11, the water carried thereby from the quenching zone 4 is removed by the action of the retro-blowing water remover 12. Any residual water is blown off by the high-pressure air ejected from the air blower 13 to dry up the surface.

A finishing temperature sensor 17, a quenching ending temperature sensor 18 and a reelevated temperature sensor 19 are respectively provided at the exit end of the finishing mill 1, the water removing device 11 and the temperature reelevated zone 5. Reference character (a) designates the point at which the finishing temperature is measured, (b) the point where the surface temperature of the quenched steel is measured, and (c) the point where the reelevated temperature of the steel is measured. The quenching ending temperature sensor 18 is normally provided at a point 1 to 2 m away from the exit end of the quenching zone 4. The temperature sensors 17 to 19 are noncontacting thermometers of, for example, the radiation type.

Based on the experimental results obtained by the inventors, the most satisfactory outcome is known to result when the quenching zone 4 has an effective length L (mm), which is the length over which the rolled piece is sprayed with cooling water, given by the following equation:

$$L=0.9\cdot d^2\cdot V(9.80-0.97\cdot lnQ)+K \quad (1)$$

$$0.5\geqq Q/\pi dL\cdot 10^3\geqq 0.2 \quad (2)$$

where d=diameter of the piece (mm)

V=rolling speed (m/sec)

Q=feed rate of cooling water ($m^3$/hr)

K=coefficient of correction selected within the range of −9000 mm to +3000 mm

In equation (1), $d^2\cdot V$ represents the volumetric production rate. The effective length L of the quenching zone increases as $d^2\cdot V$ increases. The effective length L becomes shorter as the cooling water feed rate decreases. The coefficient of correction k indicates the allowable range in which the rolled steel attains the desired level of mechanical properties. When the finish-rolling temperature $T_f$ is not lower than 780° C., the coefficient K is chosen within the range of −6000 mm and +3000 mm. When $T_f$ is under 780° C. and not lower than the $Ar_1$ transformation temperature, the range is between −9000 mm and +1000 mm. In either case, it is preferable to adopt the median or a nearby value in the range of the coefficient K applicable to each finishing temperature. When such a value is chosen, the desired product quality can be attained steadily. The first object of this invention is to improve toughness by suppressing grain growth after recrystallization and attaining finer grains than the austenite grain size 8 (according to the Japanese Industrial Standards). To achieve this goal, the finishing temperature should preferably be chosen from the range of not lower than 780° C. and not higher than 850° C. The second object is to achieve further enhancement of toughness and softening by acceleration precipitation of fine-grained ferrite grains and ferrite-pearlite transformation. Such acceleration can be accomplished through the utilization of working energy (strain) that is not set free but suppresses recrystallization. The preferable temperature to achieve this goal is not lower than the $Ar_1$ transformation temperature and under 780° C. Without dividing into two equations, the value K can be expressed as $40\cdot T_f-37000<K<33\cdot T_f-25000$ using functions of the finishing temperature $T_f$.

Equation (2) is for determining the preferable range of water feed rate or water flux density to be adopted in the quenching zone when the rolled steel can be aligned with the cooling apparatus without causing serious uneven cooling. The lower limit of 0.2 means that the quantity of water sprayed in the unit heat-transfer area is 200 $m^3/hm^2$, or preferably not lower than 250 $m^3/hm^2$. This is the requirement for preventing the circumferential uneven cooling of the rolled steel and cooling of the rolled steel and keeping the quality variation within the desired limits. The upper limit at 0.5 means that the water flux density stands at 500 $m^{3/hu'}$at which the relationship between the heat transfer rate (the boundary-film heat transfer rate) at the surface of the rolled steel $\alpha_s$ and the radial heat transfer rate in the rolled steel $\alpha_i$ becomes $\alpha_s>>\alpha_i$. The cooling rate changes little beyond this limit.

Adjustment is made so that the temperatures at the points (a), (b) and (c) become equal to the predetermined target values. In this invention, the effective length L of the quenching zone is appropriately set on the basis of the rolled steel diameter d, the rolling speed V and the cooling water feed rate Q. Therefore, it is quite easy to satisfy the above temperature requirements for the heat treatment of steels for low-temperature services having stable excellent properties.

Now, a method of surface-quenching rolled steel using the above-described apparatus will be described. The required length of the cooling line 3 or the effective length of the quenching zone L differs with the size of the rolled steel. A preferred embodiment shown in FIG. 2 has a water removing device 11 installed at the rearmost end of the cooling line 3 so that the quenching starting point can be varied depending on the diameter of the rolled steel M, thereby bringing the quenching ending point to immediately ahead of the air blower 13 incorporated in the water removing device. For instance, quenching of 38 mm and 19 mm diameter bars starts at different points. This adjustment is readily accomplished by opening and closing the control valves 9.

Figure 2:
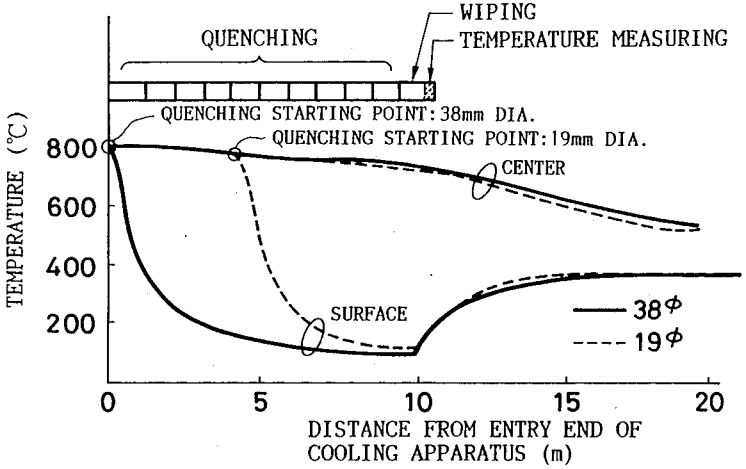
FIG. 2 is a diagram showing an example of a cooling curve for bar or wire rods.

Steel sprayed with water gets cooled because of the heat transfer from the steel to the water. The cooling rate by heat transfer is determined by the heat transfer rate of the steel. Therefore, the surface temperature drops sharply immediately after cooling begins as shown in FIG. 2. In the example shown in FIG. 2, the surface temperature drops to below 250° C. in approximately 0.7 second. The heat transfer rate at the surface of rolled steel is a function of the surface temperature thereof which becomes larger with a drop in temperature. This is because the steel is cooled as a result of the transfer of heat that occurs when the sprayed water boils at the surface thereof. While cooling progresses, the mode of heat transfer changes from film boiling to nucleate boiling. Equation (3) shows an example of the influence coefficient K on the heat transfer rate at rolled steel surface temperature $T_s$.

$$K=\exp(3.28-0.0049\cdot T_S) \quad (3)$$

Figure 3:
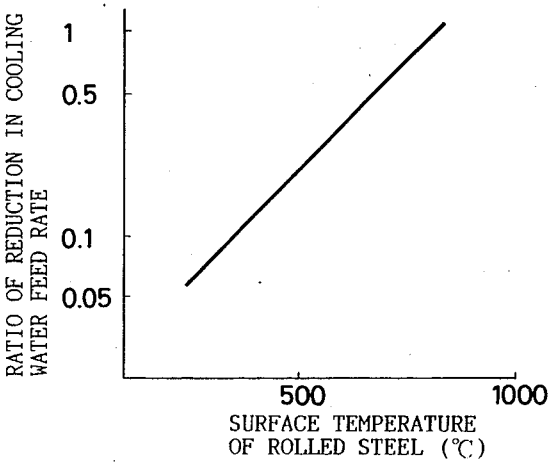
FIG. 3 is a diagram showing the relationship between the surface temperature of bar or wire rods and a reduction in the cooling water feed rate.

Equation (3) shows that the heat transfer rate increases exponentially as the roller steel surface temperature $T_S$ drops. Therefore, even if the cooling water feed rate is decreased in inverse proportion to the influence coefficient K derived from equation (3) as the steel temperature drops, the mean heat transfer rate of approximately $10^4$ to $2\times10^4$ kcal/m$^2$h°C. required for direct surface-quenching can be secured. FIG. 3 shows the approximate curve along which the cooling water feed rate can be decreased as the rolled steel surface temperature $T_S$ drops. According to FIG. 3, the cooling water feed rate for a surface temperature of 500° C. is approximately 1/5 of the rate at 800° C. The actual feed rate is chosen within the range given by equation (2).

Therefore, it is preferable to supply ample cooling water to the cooling boxes 7 in the upstream section of the quenching zone 4 and, then, reduce the water feed rate to those in the downstream section along the curve of FIG. 3 as the surface temperature of the rolled steel M drops. In a cooling box 7 where the surface temperature drops below approximately 250° C., the desired goal can be achieved with a water feed rate that is just enough to suppress the surface temperature from increasing due to the heat transfer from the center of the rolled steel. When the cooling water feed rate (water flux density) is reduced to below the lower limit of equation (2), direct spraying, in which cooling water is directly shot against the surface, is unsuitable since it becomes difficult to secure uniform distribution of cooling water around the circumference of the rolled steel. With several cooling boxes in the downstream section, such as immediately ahead of the quenching ending point, cooling with a rotating stream of water through internal tubing, immersion cooling or mist cooling is preferable.

By thus progressively reducing the cooling water feed rate, the rolled steel entering the water removing device 11 just behind the quenching zone 4 is wet only to a minimum extent. As a consequence, the water removing device 11 can thoroughly remove water with a minimum load.

Then, the surface temperature is measured. This measurement of the quenching ending temperature is performed immediately after the removal of water (about 0.04 second after removing of water in the embodiment being discussed). For this reason, the quenching ending temperature sensor 15 is installed about 0.1 m away from the wiper 11 or 1 m to 2 m downstream of the point where quenching ends.

The rolled steel M thus cooled travels from the cooling line 3 to a coiler 21 in the atmosphere. The temperature increase to the reelevated temperature is measured at an intermediate point where the temperature difference between the surface and center of the steel becomes not more than 10° C. (for example, after approximately 17 seconds in the embodiment being described).

The water feed rate to each cooling box 7 is determined based on the measured temperatures so that the roller steel M is cooled at the desired cooling rate. The temperatures measured by the finishing temperature sensor 17, quenching ending temperature sensor 18 and relevated temperature sensor 19 at the points (a), (b) and (c) are input in a controller 20. Meanwhile, cooling conditions based on the properties, size, rolling conditions and quality requirements of the steel M are preliminarily set in the controller 20. The controller 20 sends out operating signals to the control valves 9 in accordance with such cooling conditions and temperatures so that the rolled steel M is cooled along the desired cooling curve.

In the quenching zone, the roller steel is rapidly cooled until the surface temperature comes within the following range as described previously:

$$145\cdot t/r^2+130<T<152\cdot t/r^2+240 \quad (4)$$

where

T=surface temperature of rolled steel at a measuring point 1 m to 2 m away from the point where quenching ends (°C.)

t=time in which the rolled steel travels from the quenching ending point to the temperature measuring point (hr)

m=radius of the rolled steel (m).

Figure 4:
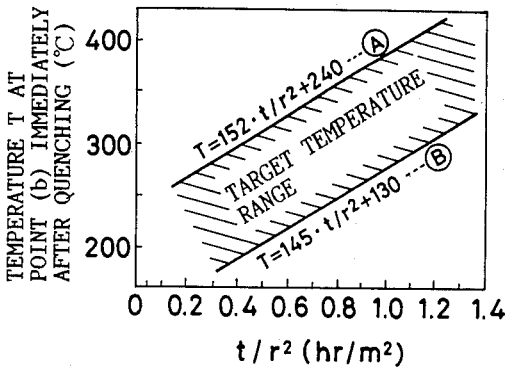
FIG. 4 is a diagram showing the target temperature determined at a point 1 to 2 m away from the exit end of a quenching zone.
Figure 5:
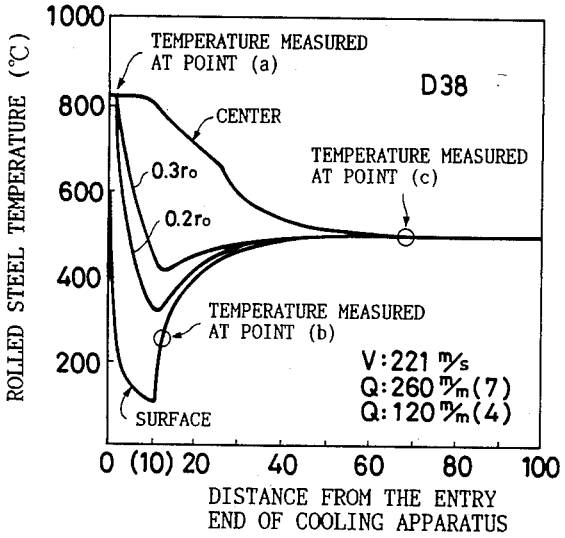
FIG. 5 is a diagram showing an example of a cooling curve for rolled steels.

FIG. 4 is a diagram showing the temperature range satisfying equation (4). FIG. 5 is a diagram showing an example of a cooling curve (a cooling pattern) of the rolled steel cooled in the cooling line just described.

The surface temperature of the rolled steel before reaching the quenching zone is kept at an appropriate level not lower than the $Ar_1$ transformation temperature, which is normally chosen depending on the type of steel and the desired mechanical strength, by controlling the temperature at which the steel is discharged from the reheating furnace. To produce rolled steels having improved toughness by controlling only the temperature of the quenched steel at the measuring point (b), the steel must be rapidly cooled to a temperature chosen within the range given by equation (4) in the quenching zone whose effective length L is determined by equation (1). Equation (4) gives the temperature of the rolled steel at the point (b) 1 m to 2 m away from the rearmost end of the quenching zone so that the mechanical properties of the rolled steel are kept within the desired range. The elapsed time t after the completion of quenching is included in the equation that represents curves A and B in FIG. 4 to correct the time of arrival at the point (b) according to the rolling speed. Even among the rolled steels of the same diameter cooled in the same pattern, those rolled at a slower speed take a longer time t after completion of quenching in reaching the point (b), with a resulting increase in the steel temperature. Here, the curve A shows the limit within which the thickness of the tempered martensite in the surface of rolled steel can be increased to the greatest allowable extent to increase tensile strength and ductility (as determined by the Charpy impact test). Beyond this limit, elongation drops to such a low level that the desired properties are unattainable. The curve B shows the opposite limit within which elongation is increased to such an extent that the lowest allowable tensile strength and ductility are obtained.

When the steel temperature at the measuring point (b) is controlled within the target range by specifying the effective length of the quenching zone (i.e., the quenching time), the history of the steel temperature beyond that point depends solely on the rate of heat transfer in the steel. This means that the temperature at the conventional relevated temperature measuring point (c) is controlled to the target level. As a consequence, the thickness of the tempered martensite in the surface is controlled as desired, which, in turn, leads to the steady production of rolled steel having excellent toughness. When equations (1) and (2) determining the effective length of the quenching zone and equation (3) determining the target temperature at the point (b) immediately behind the quenching ending point are used in combination, faster corrective action can be taken on the next piece when any trouble occurs on the piece begin treated. Control of the cooling water feed rate within for different parts of the same piece can also be achieved easily by means of quick feedback.

If the cooling line 3 is spaced substantially away from the finishing mill 1 on account of the plant layout or other limitations, the time between finish-rolling and the start of quenching increases to bring about the coarsening of the austenite grain size and the occurrence of ferrite. It is therefore preferable to send the rolled steel into the quenching line as quickly as possible.

EXAMPLE I

Using a cooling apparatus as shown in FIG. 1, 3.5 percent nickel steel was treated. With the steel temperature at the finishing point (a) standing at 820° C., the bar diameter d at 38 mm, the finish-rolling speed V at 2.2 m/sec and the cooling water feed rate Q satisfying equation (2) at 380 $m^3$/hr, the effective length L of the quenching zone was derived from equation (1). The selected coefficient of correction K was −1545. The choice was for making the length of the quenching zone rather short since the principal aim was set on the attainment of improved elongation through the limitation of quenching depth. The length L thus derived was 10 m. The bar temperature was measured using pyrometers 18 and 19. The determined temperature at point (b), which was approximately 1.6 m away from the rear end of a retro-blowing water remover 12, was approximately 250° C., falling well within the preset target temperature range of 210° C. to 325° C. The temperature of the reelevated steel at point (c), which was approximately 58 m away, was 500° C., hitting the preset target of 500° C. plus/minus 50° C.

All this resulted in the steady production of 3.5 percent nickel steel bars having yield point $\sigma_y \geqq 410$ N/$mm^2$, elongation $E1 \geqq 20\%$ and ductility $vE_{-120} \geqq 100$ Joule which are required of reinforcing steel bars for low-temperature services.

Next, the structure of the cooling apparatus used will be described.

Figure 6:
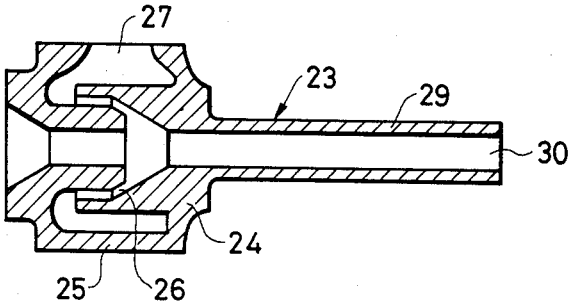
FIG. 6 is a cross-sectional view of a cooling box equipped with a direct spray nozzle.

A cooling apparatus as shown in FIG. 6 cools the rolled steel with cooling water that is directly sprayed thereon and held in a tubular passage. This type of cooling apparatus generally requires a large quantity of cooling water. The water carried by the rolled steel leaving the cooling apparatus cannot be readily wiped off. Insufficient removal of water causes considerable variation in the recuperated temperature and builds up an undesirable resistance to the passage of the rolled steel through the cooling apparatus.

The cooling apparatus of the embodiment being described comprises a series of cooling boxes in the upstream section where the surface temperature of the rolled steel is still high, each cooling box containing a direct spray nozzle directed toward the surface of the steel, and another series of cooling boxes in the downstream section where the surface temperature is lower, each cooling box in this section containing a spiral spray nozzle directed along a tangent to the inner circular surface of the passage.

The roller steel is quenched until a given temperature (such as the martensite transformation temperature) is reached at a desired depth below the surface. There is a cooling box in which such quenching is completed, and it is preferable that the cooling boxes down to at least two steps upstream of such a cooling box contain a direct spray nozzle. The rest of the cooling boxes contain a spiral spray nozzle. The spiral spray nozzles are used where the surface temperature of the rolled steel drops below 600° C. The number of cooling boxes containing a direct spray nozzle is determined depending on the diameter of the rolled steel.

In each cooling box of the upstream section, a large quantity of cooling water is supplied to a tubular passage in such a manner as to directly strike against the surface of the rolled steel. The cooling water remains in extensive contact with the surface of the rolled steel, thereby preventing the formation of a film of steam thereon. Consequently, the heat transfer coefficient between the steel surface and cooling water increases to permit efficient cooling of the rolled steel.

In each cooling box of the downstream section, cooling water sprayed from a nozzle flows toward the exit end together with the rolled steel while running spirally therearound. The cooling water cools the rolled steel while spirally flowing along the surface thereof. As the surface temperature drops below 600° C., nucleus boiling that remarkably increases the heat transfer rate occurs. Therefore, adequate quenching can be achieved by immersing the rolled steel in a spirally flowing stream of water. The sprayed water encloses the rolled steel in a spirally flowing stream, rather than striking in spots, thereby ensuring uniform cooling. The sprayed water is annular when viewed cross-sectionally, having a hollow opening in the center thereof. Consequently, the cooling water concentrates on the surface of the rolled steel, and little resistance is offered to the travel of the rolled steel, especially at the leading end thereof. As the rolled steel leaves the cooling box, the layer of cooling water carried by the steel is released therefrom by centrifugal force.

FIG. 6 shows details of a cooling box 23 equipped with an annular direct spray nozzle. As is illustrated, the cooling box 23 comprises a shooting segment 24 and a cooling segment 29. The shooting segment 24 consists of a casing 25 that contains a direct spray nozzle 26 in the form of an annular slit. Sloped toward the upstream side, the direct spray nozzle 26 is directed toward the rolled steel M. A cooling water reservoir leading to a water-feed port 27 is provided near t he periphery of the casing 25.

The cylindrical cooling segment 29 horizontally extends from the casing 25, with the downstream end thereof opening into the atmosphere.

Cooling water ejected from the direct spray nozzle 26 fills the passage 30 in the cooling segment 29, in which the rolled steel M is immersed and cooled.

Figure 7:
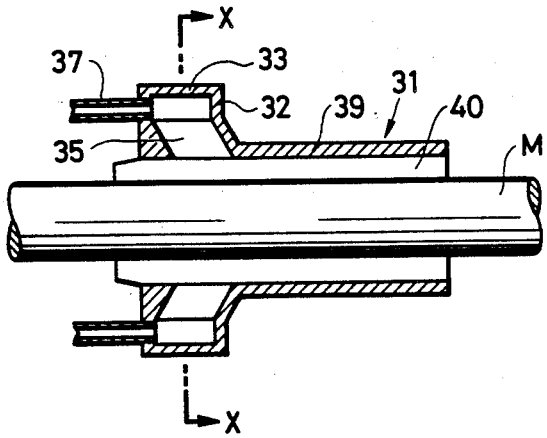
FIG. 7 is a cross-sectional view of a cooling box equipped with a rotating spray nozzle.
Figure 8:
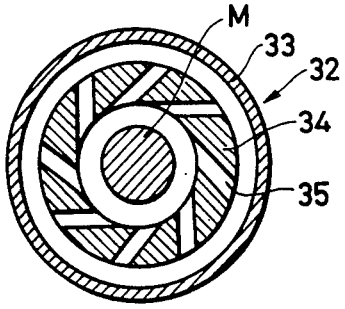
FIG. 8 is a cross-sectional view taken along the line X—X of FIG. 7.
Figure 9:
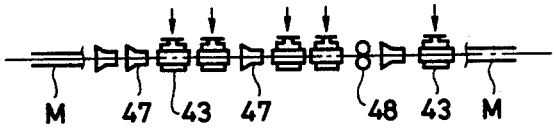
FIG. 9 schematically illustrates the manner in which a bar or wire rod is aligned with the cooling apparatus.

FIGS. 7 and 8 shows details of a cooling box equipped with a spiral spray nozzle. As may be seen, a cooling box 31 comprises a shooting segment 32 and a cooling segment 39.

The shooting segment 32 contains an annuar nozzle block 34 in which eight spiral nozzles 35 are provided. Each nozzle 35 opens tangentially with respect to the inner circular surface of nozzle block 34. A cooling water feed pipe 37 is connected to the casing 33. A cooling water reservoir is provided near the periphery of the casing 33. To appropriately direct the stream of cooling water, the nozzle block 34 should preferably have a thickness of 3 mm or over.

The cylindrical cooling segment 39 horizontally extends from the casing 33, with the downstream end thereof opening into the atmosphere. The number of the spiral spray nozzles 35 usually ranges from two to eight. Not many nozzles are required when a passage 40 is of small diameter. The spiral spray nozzle 35 may have the shape of either a slit or a round hole.

Let D denotes the inside diameter of the tubular passage 40 and d the diameter of the rolled steel M, then an appropriate thickness δ of the layer of the cooling water is expressed as follows based on a condition in which no rolled steel is present:

$$\delta \geqq (1.2 \text{ to } 1.6)(D-d)/2 \quad (5)$$

If $\delta \approx (D-d)/2$, uniform circumferential distribution of cooling water density cannot be obtained unless the rolled steel M is exactly aligned with the longitudinal central the cooling apparatus. If $\delta > (D-d)/2$, resistance to the passage of the rolled steel increases with an increase in the cooling water feed rate. The water feed rate can be decreased by increasing the ratio d/D. In order to maintain adequate cooling efficiency, the ratio d/D should preferably be maintained within the range of 0.3 to 0.8. Accordingly, the flow rate of the spiral stream and the thickness of the cooling water layers are controlled by adjusting the cooling water feed rate.

Cooling water should preferably be supplied under a pressure of 1.2 kg/cm$^2$ abs or more. A stable layer of cooling water cannot be formed in the passage 40 at a pressure below said pressure level. The water pressure must be increased as the distance between the nozzle 35 and the tip of the passage 40 increases.

The thickness of the cooling water layer is adjusted by controlling the feed rate with a throttle valve (not shown) provided in the cooling water feed pipe 37. The cooling water moves toward the exit end of the cooling segment 39 together with the rolled steel M while spirally flowing around the periphery thereof. As the rolled steel M leaves the cooling segment 39, the water carried thereby is removed from the surface thereof by the action of centrifugal force. The water thus removed flows out of the cooling segment 39.

In this embodiment, a layer of cooling water is formed around the rolled steel in the downstream section where the surface temperature thereof drops. This mode of water supply reduces the consumption of cooling water and facilitates the removal of water from the rolled steel leaving the cooling apparatus. When the cooling water is thus thoroughly wiped off, the recuperated temperature varies little. Furthermore, the resistance to the passage of the rolled steel through the cooling apparatus is reduced, too.

The following paragraphs described a modified cooling box that is adapted for use with a cooling apparatus for such a rolling mill in which the rolling speed is too fast to permit exact alignment of the rolled steel with the axis there of.

With the enhancement of productivity in mind, the rolling speed of small-diameter wire rods has recently been increased to between 90 m/secn and 110 m/sec. Various types of cooling apparatus for steel products (especially rolled steels) have been proposed (as disclosed in Japanese Patent Publications Nos. 20283 of 1976, 35007 of 1977, 44935 of 1981, 48566 of 1981 and Japanese Utility Model Publication No. 41813 of 1980). But none of such prior art items had means to prevent circumferentially uneven cooling that occurs as the rolling speed increases. When the rolled steel is off-center in a conventional cooling box, the quantity and pressure of cooling water sprayed from a nozzle contained therein varies circumferentially to cause uneven cooling. When an extreme deviation occurs, little clearance to hold the cooling water is left between the passage wall and the rolled steel, with a resulting substantial drop in cooling efficiency. As a result, alignment of the rolled steel with the center longitudinal axis of the passage in a cooling box has been an essential requisite to uniform cooling.

Figure 10:
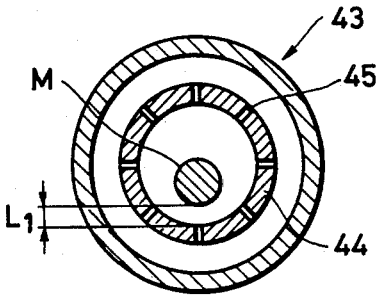
FIGS. 10 and 11 are cross-sectional views showing the eccentricity of a bar or wire rod in the cooling box.

In a cooling apparatus comprising a series of successively disposed cooling boxes 43 of the same type as shown in FIG. 10, rolled steels M of different diameters can be cooled uniformly by providing a movable guide 47 that permits alignment of each rolled steel product ahead of and behind such cooling boxes, or a movable cooling box that moves together with other cooling boxes in such a manner as to offset the deviation of the rolled steel, or a roller guide 48, either singly or in combination.

In such forced alignment, however, the moving guide 47 or cooling box 43 can produce scratches on the surface of the rolled steel in coming in contact therewith. The roller guide 48 involves a problem of bearing wear that grows increasingly serious as the rolling speed increases. The solution to this problem calls for a reduction in the rotation speed of the rollers which can be achieved through the use of larger-diameter rollers. Because of such disadvantages related to product quality, equipment cost and maintenance, few aligning measures have been taken so far. Hence, a significant cause of uneven cooling has remained uneliminated.

When the rolling speed is low, mis-alignment of the rolled steel can be corrected through the up-down adjustment of the bottom roller of a roller guide 48 provided ahead of and behind a cooling box. In this way, it has been possible to achieve substantially uniform cooling with a conventional cooling box by raising the cooling water density of 250 m$^3$/m$^2$hr or above, as was disclosed in Japanese Provisional Patent Publication No. 12830 of 1986 or as is specified by equation (2) given hereinbefore. As the rolling speed increases, however, aligning means, such as the roller guide 48, becomes unusable since it offers resistance to the travel of the rolled steel, sometimes even causing buckling or other troubles. When no such aligning means is used, the rolled steel M travelling through the cooling box 43 drop to such an extent as sometimes to come in contact with the bottom of the passage therein due to its own weight. In this state, cooling water concentrates in the wider space between the passage wall and the rolled steel M created thereabove, thereby causing overcooling in that region. On the other hand, little cooling water is admitted in the significantly reduced space below the rolled steel M, causing undercooling in that portion. The overall result is a substantially uneven cooling around the periphery of the rolled steel. Thus, alignment of the rolled steel in a cooling apparatus, which is an essential requisite to uniform cooling, has been made difficult with increased rolling speed. The occurrence of uneven cooling has heretofore remained unpreventable.

Figure 11:
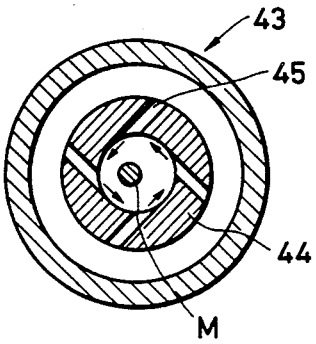

Previously the inventors revealed (in Japanese Provisional Patent Publication No. 12830 of 1986) that high-efficiency uniform cooling can be achieved with the use of cooling boxes 43 of the type shown in FIGS. 10 and 11, in which cooling water is sprayed with cooling water density of not lower than 250 $m^3/m^2hr$ onto the rolled steel M that is kept out of contact with the inner tube 44 therein preferably by a clearance of 2 mm to 10 mm or above, which is designated as the minimum clearance $L_1$ (between the inner tube 44 and the rolled steel M) in FIG. 10. With an increase in the rolling speed, however, it became difficult to keep the clearance $L_1$ at 2 mm to 10 mm or above when no aligning means was usable. Under such conditions $L_1$ became substantially equal to zero. It was empirically proved that increasing cooling water density in such a state aggravates, rather than decreases, uneven cooling.

Cooling of rolled steel in a cooling box 43 having a spray nozzle of the type shown in FIGS. 10 and 11 is usually achieved through the direct impingement of the cooling water sprayed from nozzles 45 and the immersion in the cooling water flowing through a passage 40. When the rolled steel M is off-centered in the cooling box 43 in which a definate quantity of cooling water is sprayed from the nozzles 45 equally spaced around the inner tube 44 as shown in FIG. 10, the clearance between the inner tube and rolled steel in both direct-spray and immersion cooling segments becomes too narrow in some portions to admit as such cooling water as is needed for adequate cooling.

In the preferred embodiment being described, uneven cooling is prevented by making up for a drop in cooling efficiency by increasing the quantity or pressure of the cooling water directly sprayed where such a drop in cooling efficiency is anticipated. Uniform cooling is ensured by circumferentially varying the quantity or pressure of cooling water sprayed from nozzles that are disposed perpendicularly to the direction in which the rolled steel travels through a cooling box of the type shown in FIGS. 12 to 14.

Figure 12:
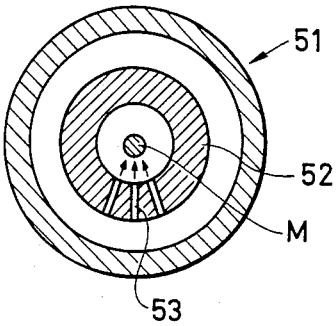
FIGS. 12 to 14 are cross-sectional views showing preferred embodiments of the cooling box according to this invention.

A cooling box 51 shown in FIG. 12 has cooling water spray nozzles 53 concentratedly disposed where the clearance between the rolled steel M and the inner tube 52 becomes narrow. Occurrence of uneven cooling on the exit side of the quenching zone is prevented by forcibly cooling the rolled steel in an immersion cooling section or else where undercooling occurs with cooling water sprayed from such strategically positioned nozzles.

Figure 13:
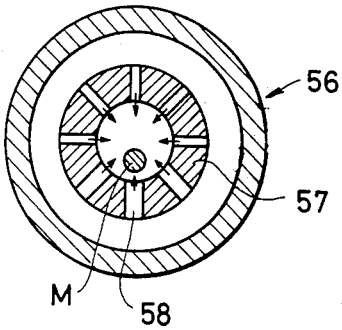

In a cooling box 56 shown in FIG. 13, the cross-sectional area of spray nozzles 58 is made larger than elsewhere in a area where the clearance between the rolled steel M and the inner tube 56 is reduced so that the portion undercooled in an immersion cooling section or else is selectively cooled with a larger quantity of water. By so doing, occurrence of uneven cooling on the exit side of the quenching zone is prevented.

Figure 14:
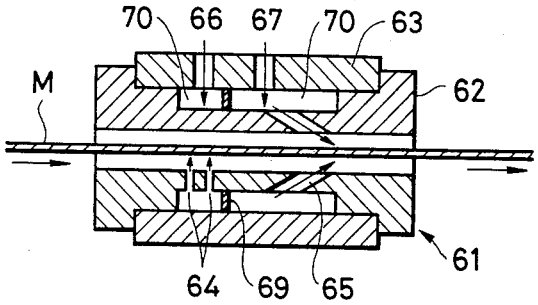

A cooling box 61 shown in FIG. 14 has a plurality of cooling water spray nozzles 64 and 65 disposed in series in the direction of travel of the rolled steel M and two or more independent cooling water feed ports 66 and 67 that are capable of varying the quantity or pressure of cooling water along the circumference of the rolled steel M. Preferably, a partition 69 is provided so that the pressure in a cooling water reservoir 70 leading to the individual cooling water feed ports 66 and 67 can be varied as desired. Provision of two or more independent water feed ports 66 and 67 permits adjusting the water feed rate to the nozzles 64 and 65 that are concentrated in some limited portion of the circumference or to the nozzles having different cross-sectional areas, depending on the degree to which the rolled steel M deviates from the center axis of the line. With this arrangement, the quantity or pressure of cooling water can be varied circumfernetially as required. The nozzle 64 at the left of FIG. 14 may be of the spray type shown in FIG. 12 or 13 while the nozzle 65 at the right may be of the type that is equally spaced around the circumference as shown in FIG. 10 or 11. But the nozzles 64 and 65 are by no means limited to the above combination. The two different types of nozzles may be reversed, as well. Either way, the combination of the upward spraying nozzles as shown in FIG. 12 or 13 and the equally spaced nozzles ensures uniform cooling; the former cools the red-hot lower portion to cover the shortage of cooling water caused by the deviation of the rolled steel M while the latter forms a stable film of cooling water around the periphery thereof.

The cooling efficiency of the three different types of cooling boxes shown in FIGS. 14, 13 and 12 is higher in that order. Where the minimum clearance $L_1$ between the inner tube 44 and the rolled steel M becomes 2 to 10 mm or less in a line comprising a plurality of cooling boxes disposed in series in the travelling direction of the rolled steel M as shown in FIG. 1, one or more cooling boxes of any single type or a plurality of cooling boxes of two or more types may be employed in combination depending on the desired cooling efficiency.

EXAMPLE II

The following paragraphs describe an example of cooling achieved with the use of a cooling apparatus comprising cooling boxes 61 of the type shown in FIG. 14 that has the highest cooling efficiency.

Six cooling boxes 61 were disposed where the minimum clearance $L_1$ between the inner tube 44 and the rolled steel M is not larger than 2 to 10 mm between the finishing mill and coiler of the line having no aligning means. As is shown in FIG. 14, each cooling box 61 had a space 70 defined by an inner tube 62 and an outer tube 63 and divided into two chambers by a partition 69. Each of the two chambers had an independent cooling water feed port (designated by 66 and 67). A spray nozzle 64 at the left was of the type in the cooling box 51 shown in FIG. 12 and a spray nozzle 65 at the right was of the conventional vortex nozzle type which is equally spaced around the periphery.

Figure 15:
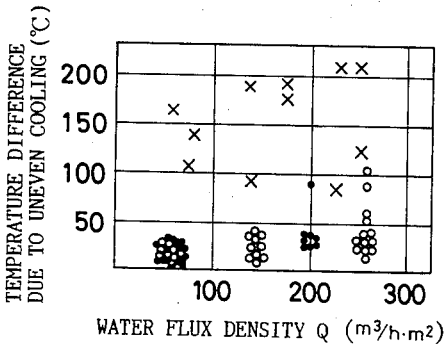
FIG. 15 shows patterns of uneven cooling resulting from the application of the cooling method of this invention and a conventional one.

For the purpose of comparison, cooling boxes 23 having an annular slit type nozzle 26 as shown in FIG. 6 were arranged in the same manner as above. The rolled steels leaving the finishing mill at a speed of 90 m/sec to 95 m/sec were water-cooled from 950° C. to 810° C. The diameter of the rolled steels and cooling water density were as shown in FIG. 15 and the legends thereon. In the cooling box 61, cooling water was supplied to the two feed ports 66 and 67 at a ratio of 2 to 1.

FIG. 15 compares the patterns of uneven cooling occurring in the two lines operated under the conditions just described. As is obvious from FIG. 15, the rolled steels cooled in the cooling boxes of FIG. 14 exhibited fewer signs of uneven cooling (indicated by o and ●). Unevenly cooled spots were reduced to approximately $\frac{1}{3}$ to $\frac{1}{4}$ of those (marked by x) on the rolled steel cooled with cooling boxes 23 equipped with an annular slit type nozzle 26. Here, uneven cooling means the difference between the highest and lowest temperatures determined around the periphery of the rolled steel by use of radiation pyrometers (having a measuring field of approximately 1 mm square).

What is claimed is:

1. A method of cooling rolled steel comprising the steps of:

hot-rolling steel to the desired diameter;

subsequently passing the steel along a path and quenching the hot-rolled steel by spraying cooling waters thereon to cool the surface portion of the steel to a temperature within a given range below the bainite transformation temperature, the temperature range being defined as $$145 \cdot t/r^2 + 130 \leqq T \leqq 152 \cdot t/r^2 + 240$$

where

T = surface temperature of the rolled steel at a temperature measuring point along said path 1 m to 2 m away from the point along said path where quenching ends (°)

t = time required for the rolled steel to travel along said path from the quenching ending point to the temperature measuring point (hr)

r = radius of the rolled steel (m); and subsequently continuing to pass the quenched steel along said path in ambient atmosphere for causing the temperature of the surface portion of the rolled steel which has been cooled by the quenching to reelevate to a reelevated temperature as a result of the conduction of the heat retained in the inner part of the rolled steel to the surface portion of the steel for tempering the steel.

2. A method according to claim 1, further comprising controlling the feed rate of cooling water for obtaining the desired amount of cooling on the basis of the surface temperature of the rolled steel immediately after the end of quenching and the surface temperature of the rolled steel at the reelevated temperature.

3. A method according to claim 1, in which said quenching comprises supplying a quantity of cooling water which becomes increasingly small in the direction of travel of the rolled steel along the path.

4. A method according to claim 1, in which said step of spraying cooling water comprises spraying cooling water from nozzles surrounding the rolled steel and varying the quantity or pressure of water around the circumference of the rolled steel for uniformly cooling the surface of the rolled steel.

5. A method according to claim 1, further comprising removing the residual water on the surface of the rolled steel by spraying water onto the surface of the rolled steel in a direction opposite to the direction of travel thereof at the point where quenching ends and subsequently blowing a stream of air thereover.

* * * * *